United States Patent [19]

Mizuguchi et al.

[11] Patent Number: 4,603,334

[45] Date of Patent: Jul. 29, 1986

[54] MULTI BEAM ANTENNA AND ITS CONFIGURATION PROCESS

[75] Inventors: Yoshihiko Mizuguchi; Fumio Watanabe, both of Tokyo, Japan

[73] Assignee: Kokusai Denshin Denwa Kabushiki Kaisha, Tokyo, Japan

[21] Appl. No.: 515,839

[22] Filed: Jul. 21, 1983

[30] Foreign Application Priority Data

Feb. 4, 1983 [JP] Japan ..... 58-16129

[51] Int. Cl.[4] ..... H01Q 19/19; H01Q 15/16

[52] U.S. Cl. ..... 343/779; 343/781 P; 343/914

[58] Field of Search ..... 343/779, 781 P, 781 CA, 343/914

[56] References Cited

U.S. PATENT DOCUMENTS 4,145,695 3/1979 Gans ..... 343/781 P
4,355,314 10/1982 Ohm ..... 343/781 CA
4,491,848 1/1985 Dragone ..... 343/914

*Primary Examiner*—Eli Lieberman
*Attorney, Agent, or Firm*—Pollock, Vande Sande and Priddy

[57] ABSTRACT

This invention relates to a multi-beam antenna and a method of configuring the same, where the antenna consists of a main reflector, a plurality of horns for exciting the main reflector, and separate sub-reflectors for correcting phase errors of respective beams caused by reflection at the main reflector, or an integrated sub-reflector which is substituted for said separated sub-reflectors.

3 Claims, 7 Drawing Figures

MULTI BEAM ANTENNA AND ITS CONFIGURATION PROCESS

BACKGROUND OF THE INVENTION

1. Field of the Invention

This invention relates to a reflector type multibeam antenna and a method of configuring the antenna.

2. Description of the Prior Art

There are prior art multi-beam antennas composed of several reflectors such as (1) a uni-focal antenna: e.g., an offset paraboloid antenna, and an offset cassegrain antenna and (2) a bifocal antenna.

The former, or the uni-focal antenna of (2), has two foci: one in the vicinity of the reflector and the other at an infinite distance therefrom and is available as a high gain single beam antenna.

The latter, or the bifocal antenna of (2), consists of a proper arrangement of a main reflector and sub-reflectors, having four foci: two near the reflectors and the other two far from them. As the bifocal antenna can radiate at least two high performance beams, it is better than the antenna of (1) in principle.

An antenna having the aforementioned foci has the characteristic that the phase error at its aperture surface is proportional to the amount of deviation when the antenna is fed at a point deviated from the foci. Because of this characteristic, the performance of the beam radiation (e.g., gain and side-lobe characteristics) becomes worse at increasing beam direction angles relative to the direction of the focus at the infinite distance.

FIG. 1(*a*) shows a uni-focal antenna radiation pattern in case of offset feeding. The abscissa of FIG. 1(*a*) is the beam direction angle $\theta$ in the direction of the infinite distant focus, and the ordinate represents relative power.

In the figure, $\theta=0$ implies the front end direction of the antenna where the peak value is maximum and the side-lobes are small.

In a uni-focal antenna, the direction represented by $\theta=0$ is in agreement with the direction of focus in infinite distance. At angle $\theta_1$, the peak value is smaller and the sidelobes are larger than those at $\theta=0$. The dotted line of the FIG. 1(*a*) represents an envelope of the peak values.

FIG. 1(*b*) shows the contours of the envelope represented in FIG. 1(*a*).

FIG. 2(*a*) shows the radiation patterns of a bifocal antenna having offset feeding. In the figure, $\theta=0$ implies the front end direction of the antenna, and $\theta=\pm\theta_0$ represents the direction of focus in the infinite distance. The dotted line in FIG. 2(*a*) shows the peak envelope, and FIG. 2(*b*) shows the contours of the envelope shown in FIG. 2(*a*).

From FIGS. 1 and 2, it is apparent that the performance of the radiation beam is deteriorated as the angle $\theta$ of beam direction with infinite focus direction increases. As the uni-focal antenna and the bifocal antenna have the characteristics mentioned above, a multibeam antenna provided with three or more feeder horns in front of the main reflector of either of the above mentioned types of antenna may generate one or more poor performance beams. To get a multi-beam antenna free from this inconvenience, some attempts such as adjusting the phase of the poor performance beams have been made.

However, the disadvantages of such a phase adjusting method is that it is time consuming, troublesome work.

In addition, requires the use of electric component parts such as a phase shifter, which pushes the cost up.

SUMMARY OF THE INVENTION

It is an object of this invention to provide a multibeam antenna which is free from the prior art deficiency mentioned above, therefore being free from beam phase adjustment, and simple in structure. It is an another object of this invention to provide a configuration process for such an antenna.

The multi-beam antenna of this invention includes a main reflector and several horns for exciting it, and it is characterized by the provision of sub-reflectors for each beam, each of which is differently lagged in phase from the others at the main reflector, thereby completely correcting the phase errors.

Another object of this invention is to provide an integrated sub-reflector, which is equivalent to a combination of said sub-reflectors provided one for each beam whose phase is lagged differently from others at the main reflector.

A further object of this invention is to offer a method of implementing a sub-reflector of the type mentioned above.

DETAILED DESCRIPTION OF THE INVENTION

A principle of this invention will be explained in below. It is known that a prior art composite reflector system, consisting of a rotatively symmetrical main reflector and at least one sub-reflector, causes aberration on the aperture surface. Conversely, a group of rays traveling through the aperture surface to several points on the main reflector and further going to the sub-reflector do not focus on a point after reflection thereon.

Figure 1:
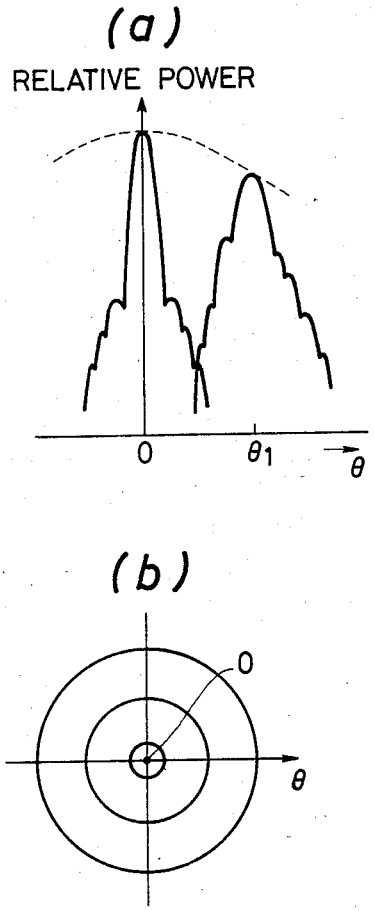
FIG. 1(*a*) illustrates radiation patterns of a prior art uni-focal antenna with offset feeding, and FIG. 1(*b*) shows the contours of the envelope illustrated in FIG. 1(*a*)
Figure 2:
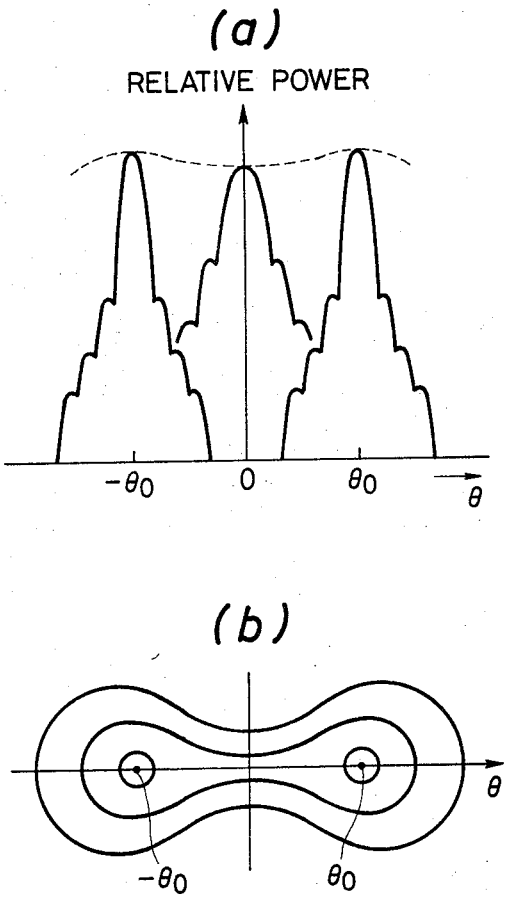
FIG. 2(*a*) illustrates radiation patterns of a prior art bifocal antenna with offset feeding, and FIG. 2(*b*) shows the contours of the envelope illustrated in FIG. 2(*a*)
Figure 3:
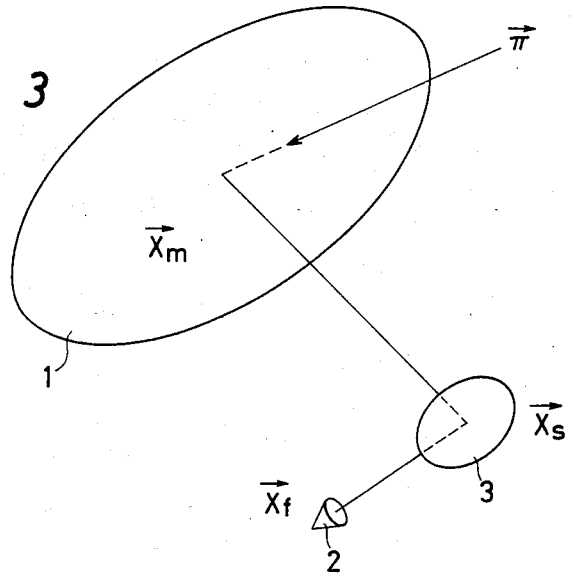
FIG. 3 diagrammatically illustrates a multibeam antenna that is exactly free from spherical aberration throughout the aperture surface.

However, the inventor of this invention has found that a sub-reflector 3 of the type shown in FIG. 3, with its surface $\overrightarrow{Xs}$ defined by the equation below, is available for a bifocal reflector antenna which is exactly free from aberration throughout the aperture surface. In FIG. 3, the notation $\overrightarrow{Xm}$ stands for a vector of a main reflector surface 1, $\overrightarrow{n_m}$ stands for a unit normal vector at a point on the main reflector surface represented by said vector $\overrightarrow{Xm}$, $\overrightarrow{Xf}$ stands for a vector of a feed horn 2, and $\overrightarrow{\pi}$ a direction of the wave front arriving at the main reflector 1.

$$\vec{X_s} = \vec{X_m} + \vec{Si_s}$$

-continued $$\text{where } \vec{i_s} = -\vec{\pi} + 2(\vec{\pi}\cdot\vec{n_m})\vec{n_m}$$

$$S = \frac{(K - \vec{\pi}\cdot\vec{X_m})^2 - (\vec{X_m} - \vec{X_f})^2}{2\{K - \vec{\pi}\cdot\vec{X_n} + \vec{i_s}(\vec{X} - \vec{X_f})\}}$$

In above formula, K is the total length of the path of a ray which travels from the feed horn through a sub-reflector and a main reflector to an aperture surface.

A detailed explanation about the above formula will not be given here, becuase it is shown in the specification of Mizuguchi et al U.S. Pat. No. 4,360,815 granted Nov. 23, 1982, for "Bifocal Reflector Antenna and Its Configuration Process.

With the sub-reflector 3 designed in accordance with said formula, all rays reflected at points on the main reflector 1 are focused on one point at the feed horn 2. In other words, the sub-reflector 3 makes equally long paths for all rays radiated from feed horn 2 and travelling through sub-reflector 3 and main reflector 1 to the aperture surface, giving no aberration.

The present invention is based on the above effect discovered by the inventor. The invention will be explained in detail below.

Figure 4:
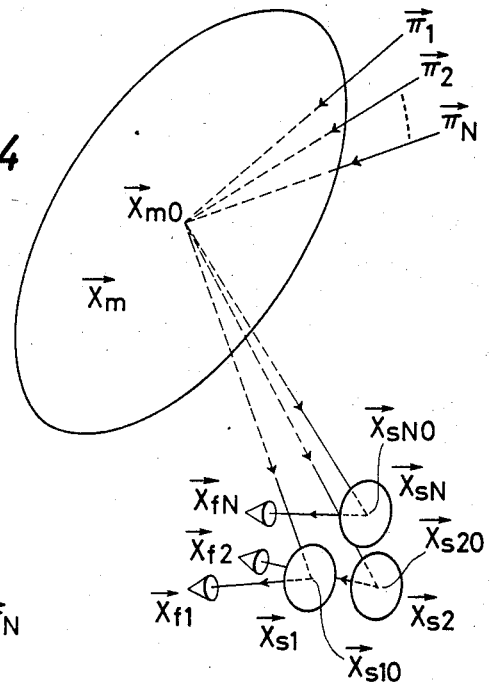
FIG. 4 is a conceptual figure of a first embodiment of this invention.

FIG. 4 shows an embodiment of this invention, in which N beams are fixed in their directions and each is directed at a relatively large angle to the adjacent beams. In the figure, a vector of a main reflector is shown as $\vec{X_m}$, vectors of N independent sub-reflectors are represented as $\vec{X_{s1}}, \vec{X_{s2}} \ldots, \vec{X_{sN}}$, feed horn vectors are represented as $\vec{X_{f1}}, \vec{X_{f2}}, \ldots, \vec{X_{fN}}$, and wave front vectors arriving at the main reflector are represented as $\vec{\pi_1}, \vec{\pi_2}, \ldots, \vec{\pi_N}$.

The notation $\vec{X_{m0}}$ stands for a vector of the main reflector approximately at its center. The notations $\vec{X_{s10}}, \vec{X_{s20}}, \ldots, \vec{X_{sN0}}$ stand for vectors of the sub-reflectors at the points where each incoming ray reflected at a point $\vec{X_{m0}}$ on the main reflector (in the figure, it is represented by a single line which is called a central ray hereinafter) crosses the sub-reflector. Notation $n_m$ stands for a unit normal vector at a beam reflection point on the main reflector $\vec{X_m}$.

Each sub-reflector surface $\vec{X_{si}}$(i=1, 2, . . . N) of this invention is made up of a curved surface formed by using formula (1) below together with given factors $X_m$, $n_m$, $X_{fi}$, and $\pi_i$(i=1, 2, . . . N).

$$\vec{X_{si}} = \vec{X_m} + S_i\,\vec{i_{si}} \tag{1}$$

$$\text{where } \vec{i_{si}} = -\vec{\pi_i} + 2(\vec{\pi_i}\cdot\vec{n_m})\vec{n_m}$$

$$S = \frac{(K_i - \vec{\pi_i}\cdot\vec{X_m})^2 - (\vec{X_m} - \vec{X_{fi}})^2}{2\{K_i - \vec{\pi_i}\cdot\vec{X_m} + \vec{i_{si}}(\vec{X_m} - \vec{X_{fi}})\}}$$

$K_i$ denotes a distance between the feed horn and the i-th wave front for a plane wave that passes through the origin.

Physically, said $\vec{i_{si}}$ represents a unit vector in the reflection direction at the point where i-th beam $\vec{\pi_i}$ is incident on the main reflector $\vec{X_m}$, and said $S_i$ represents the distance between the reflection point of the i-th beam on the main reflector surface and that of the i-th beam on the sub-reflector surface.

Since each sub-reflector $\vec{X_{si}}$ is made up of a curved surface designed in accordance with formula (1), the N antennas consisting of each feed horn $\vec{X_{fi}}$, sub-reflector $X_{si}$ and main reflector $\vec{X_m}$ may be considered to be N foci antenna exactly free from aberration for arriving rays or beams $\vec{\pi_1}, \ldots, \vec{\pi_n}$. This antenna, therefore, is available as a multi-beam antenna.

The multi-beam antenna of this embodiment can be implemented in the offset or other type of antenna. It is better to implement it in an offset form whose wave path is not interrupted.

As is obvious from the above explanation, the multi-beam antenna of this embodiment does not need phase adjustment of the beam being received at or leaving the feed horn, or a phase shifter, and is therefore easy in treatment and simple in construction.

As a condition under which the antenna is implemented, it is important that the N rays coming from a particular direction do not overlap on the sub-reflector when they are reflected at the main reflector so as to be directed to their corresponding sub-reflectors. Namely, the beam $\vec{\pi_i}$ arriving at a sub-reflector must not be reflected by another sub-reflector for another beam $\vec{\pi_m}$ in order to get to the sub-reflector $\vec{X_{si}}$ provided for the beam $\vec{\pi_i}$.

For that purpose, it is desirable for the antenna of this embodiment to have fixed beam directions and a large separation angle of between the beams. In such the case as where the beam separation angle is varied continuously, or the separation angle of between the beams is small, it is impossible to realize the multi-beam antenna shown in FIG. 4 because of partial overlap (multi-valued representation) of sub-reflectors.

Figure 5:
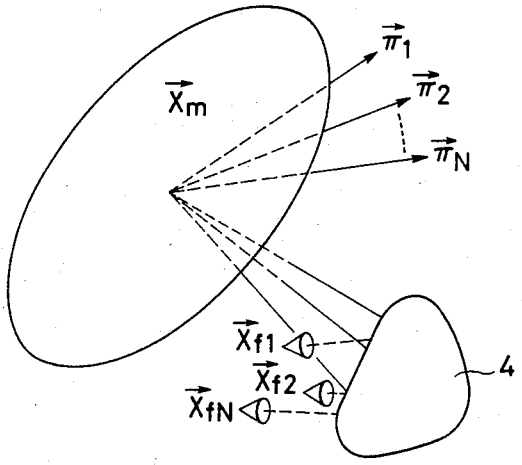
FIG. 5 is a conceptual figure of a second embodiment of this invention.

FIG. 5 shows a multi-beam antenna of a second embodiment of this invention which is not subject to the foregoing limitations. This multi-beam antenna is realizable even where the beam direction is changed continuously or the beam separation angle is small.

The antenna of this second embodiment consists of a smooth surface sub-reflector 4 (it is called an "integrated sub-reflector" hereinafter that is) substituted for the partially overlapped sub-reflectors of the first embodiment and minimized in the aperture surface phase error (or aberration) in every beam direction $\vec{\pi_1}, \vec{\pi_2}, \ldots \vec{\pi_N}$.

The antenna of this second embodiment consists of a plurality of feed horns $\vec{X_{f1}}, \vec{X_{f2}}, \ldots \vec{X_{fN}}$, a main reflector $\vec{X_m}$ and an integrated sub-reflector 4, so that it initially appears to be the same as a prior art antenna of the types previously referred to herein.

However, the main reflector and the integrated sub-reflector 4 of the embodiment shown in FIG. 5 are different from those of a prior art offset cassegrain antenna and offset bifocal antenna, and they are so designed as to form a quite new curved surface which is minimized in aperture surface phase error.

A process for determining the shapes of the two mirror surfaces used in this second embodiment, that is the main reflector surface and the integrated sub-reflector surface, will be shown below.

First, the main reflector surface is expressed by the following formula(2).

$$z_m = z_m(x_m, y_m, \vec{a}) \tag{2}$$

Normal for this surface is $$\vec{n}_m = -\left(\frac{\partial z_m}{\partial x_m}\cdot\frac{\partial z_m}{\partial y_m} - 1\right) / \sqrt{1 + \left(\frac{\partial z_m}{\partial x_m}\right)^2 + \left(\frac{\partial z_m}{\partial y_m}\right)^2}$$

where $\vec{a}$ stands for an unknown parameter vector (Ma dimensions), and $Z_m$ stands for an arbitrary given function that satisfies the following relation:

$$\partial^2 z_m/\partial x_m \partial y_m = \partial^2 z_m/\partial y_m \partial x_m$$

Furthermore, the integrated sub-reflector 4 may be represented by a linear combination of an expansion coefficient $\vec{b}$ and an expansion function $\vec{g}(x_s, y_s)$ (their dimensions are Mb) as follow:

$$z_s = {}^t\vec{b}\cdot\vec{g}(x_s, y_s) \tag{3}$$

where ${}^t\vec{b}$ stands for a transpose of a matrix of expansion coefficient $\vec{b}$.

When $\vec{X}_{fi}$, $\vec{\pi}_i$, $K_i$ and $x_m$, $y_m$, $\vec{a}$ are given, vector $\vec{X}_{si} = (x_{si}, y_{si}, z_{si})$ of the i-th sub-reflector at the point corresponding to said vectors and values is obtained from formulas (1) and (2). That is, $z_m$ is obtained from formula (2) when $x_m$, $y_m$ and $\vec{a}$ are given. Once $z_m$ is obtained, we can obtain the first term $\vec{X}_m$ of the right side of equation (1) because it is represented by ($x_m$, $y_m$, $z_m$). With $\vec{X}_{fi}$, $\vec{\pi}_i$, $K_i$ and $x_m$, $y_m$, $z_m$ determined, we can obtain the second term of the right side of said equation (1). Thus, $\vec{X}_{si}$ is determined.

Then, for each of the N beams, M points on the main reflector are considered, so that the total of MN points are taken into consideration to obtain $Z_{si}$(i=1, . . . MN) responsive to each point. The least square means I of the difference between $z_s$ and $z_{si}$ is obtained by the following formula (4).

$$I = \vec{z}^2 - {}^t\vec{z}[G]\vec{b} \tag{4}$$

where [G] is a matrix MN×Mb consisting of MN expansion function vector $\vec{g}$. The term $\vec{z}$ is a vector (of MN dimensions) whose elements are given by ($z_s$ - $z_{si}$). The term $\vec{b}$ is a vector given by the following formula (5):

$$\vec{b} = [{}^t[G][G]]^{-1}\,{}^t[G]\vec{z} \tag{5}$$

Next, we obtain a minimum value of I by looking upon the I of equation 4 obtained in above procedure as an objective function of an optimization problem concerning $\vec{a}$, $K_i$, and $\vec{X}_{fi}$. The antenna structure having minimum I obtained in this manner has the least aperture surface phase error in each beam direction.

As is described above, according to this invention, a multi-beam antenna is obtained which is exactly free from phase adjustment, simple in construction and has little or no aberration.

What we claim is:

1. A multi-beam antenna comprising a main reflector, a sub-reflector, and a plurality of horns for exciting the main reflector, characterized in that the beam phase errors generated at the main reflector are corrected by the sub-reflector and the shape $Z_s$ of said sub-reflector is determined by the equation:

$$z_s = {}^t\vec{b}\cdot\vec{g}(x_s, y_s)$$

where $\vec{b}$ stands for an expansion coefficient, $\vec{g}(x_s, y_s)$ is an expansion function, and ${}^t\vec{b}$ a transpose of a matrix of expansion coefficient $\vec{b}$, the shape $Z_s$ of the sub-reflector satisfying a minimum value of the least square means I of the difference between $Z_s$ and $Z_{si}$ referred to below, and being formed in such a way as to have the least aperture surface phase error in each beam direction, where $$I = \vec{z}^2 - {}^t\vec{z}[G]\vec{b}$$

and where [G] is a matrix MN×Mb consisting of MN expansion function vector $\vec{g}$, $\vec{z}$ is a vector (of MN dimensions) whose elements are given by ($z_s$ - $z_{si}$), $\vec{b}$ is a vector given by $$\vec{b} = [{}^t[G][G]]^{-1}\,{}^t[G]\vec{z}$$

N is the number of beams, and M is the number of points on the main reflector considered for each of the N beams, so that a total of MN points are taken into consideration to obtain $Z_{si}$ (where i=1, . . . MN) for each point on the sub-reflector.

2. A multi-beam antenna comprising a main reflector, a sub-reflector, and a plurality of horns for exciting the main reflector, characterized in that the beam phase errors generated at the main reflector are corrected by the sub-reflector and the shape $Z_s$ of said sub-reflector is determined by the equation:

$$z_s = {}^t\vec{b}\cdot\vec{g}(x_s, y_s)$$

where $\vec{b}$ stands for an expansion coefficient, $\vec{g}(x_s, y_s)$ is an expansion function, and ${}^t\vec{b}$ a transpose of a matrix of expansion coefficient $\vec{b}$, the shape $Z_m$ of the main reflector being determined by following formula:

$$z_m = z_m(x_m, y_m, \vec{a})$$

and $\vec{a}$ normal to the main reflector surface being determined by the equation:

$$\vec{n}_m = -\left(\frac{\partial z_m}{\partial x_m}\cdot\frac{\partial z_m}{\partial y_m} - 1\right) / \sqrt{1 + \left(\frac{\partial z_m}{\partial x_m}\right)^2 + \left(\frac{\partial z_m}{\partial y_m}\right)^2}$$

where a stands for an unknown parameter vector (Ma dimensions), and $Z_m$ stands for an arbitrary given function that satisfies the following relation:

$$\partial^2 z_m/\partial x_m \partial y_m = \partial^2 z_m/\partial y_m \partial x_m$$

3. A configuration process of the multibeam antenna of claim 1 or 2 consisting of a main reflector, an integrated sub-reflector placed in front of said main reflector and feed horns placed at the foci or near the foci for said integrated sub-reflector, comprising the following procedure:

(a) determine the main reflector surface $Z_m$ by $$z_m = z_m(X_m, y_m, \vec{a}) \tag{2}$$

notice M points on the main reflector for each of the N beams and obtain MN points $z_{si}$ (i=1, . . . MN on sub-reflectors corresponding to MN points on the main reflector, (b) determine the surface of the integrated sub-reflector by $$z_s = {}^t\vec{b}\cdot\vec{g}(x_s, y_s)$$

and obtain the least square means I of the difference between $z_s$ and $z_{si}$ from the equation $$I=\vec{z}^2-{}^t\vec{z}[G]\vec{b}$$

(c) obtain the mininum value of I by looking upon the I as an objective function of an optimization problem concerning $\vec{a}$, $K_i$, $\vec{X}_{fi}$, and (d) determine the surfaces of the main antenna and the integrated sub-reflector, the position of the feed horns, and the relative position of the said three in such a way as to minimize I, where $\vec{a}$=an unknown parameter vector, $\vec{b}$=an expansion coefficient series, $\vec{g}(x_s,y_s)$=an expansion function series, $\vec{z}$=a vector comprising its elements $z_s$ - $z_{si}$, and $\partial G]$=a matrix consisting of expansion function vector g.

* * * * *